United States Patent [19]

Aoyama et al.

[11] 4,392,139

[45] Jul. 5, 1983

[54] AIRCRAFT TELEVISION ANTENNA RECEIVING SYSTEM

[75] Inventors: Frank S. Aoyama, Redmond; Brian P. Stapleton, Seattle, both of Wash.

[73] Assignee: The Boeing Company, Seattle, Wash.

[21] Appl. No.: 103,815

[22] Filed: Dec. 14, 1979

[51] Int. Cl.[3] ..... H01Q 1/28

[52] U.S. Cl. ..... 343/705; 343/770

[58] Field of Search ..... 343/705, 708, 789, 770, 343/771

[56] References Cited

U.S. PATENT DOCUMENTS

| | | | |
|---|---|---|---|
| 2,908,904 | 10/1959 | Vanatta et al. | 343/708 |
| 3,086,204 | 4/1963 | Alford | 343/708 |
| 3,701,161 | 10/1972 | Gregory | 343/770 |
| 4,162,499 | 7/1979 | Jones et al. | 343/708 |

*Primary Examiner*—Eli Lieberman

*Attorney, Agent, or Firm*—Conrad O. Gardner; B. A. Donahue

[57] ABSTRACT

An omnidirectional VHF television antenna system for an aircraft which includes one pair of slot antennas on each side of the aircraft vertical fin. Each pair of antennas includes a VHF high band slot antenna and a VHF low band slot antenna. Due to co-channel interference the antenna system includes a left, right or omnidirectional azimuth response characteristic selectable by a cabin attendant through control of the antenna system antenna pattern select switch. The VHF low band slot antennas are tilted from the vertical by about 24° and the VHF high band slot antennas are disposed vertically. Signal processing circuit means coupled between the slot antennas and the antenna system output terminal includes solid state switches to select antenna coverage omnidirectional and azimuth, or to the left or right of the aircraft to minimize ghosts or co-channel interference.

5 Claims, 3 Drawing Figures

AIRCRAFT TELEVISION ANTENNA RECEIVING SYSTEM

This invention relates to aircraft television receiving antenna systems and more particularly to an aircraft television receiving antenna system including a plurality of aircraft vertical fin mounted slot antennas.

Heretofore, VHF television antennas utilized on commercial transport aircraft have included those of the loop type; however to be adequately effective over the desired frequency range this type of loop antenna had the requirement of being fairly large, e.g. 30" in diameter. Exemplary of a rotary structure for supporting a directional television antenna in an aircraft is shown in U.S. Pat. No. 3,972,045 to Perret, issued July 27, 1976. Further exemplary of the prior art mounting of a slotted antenna on each side of a vertical fin of an aircraft is the Johnson, et al. patent issued Dec. 1, 1953, U.S. Pat. No. 2,661,422.

In contrast with the aforementioned approaches to aircraft VHF television receiving antenna systems, the present system utilizes a pair of cavity backed slot antennas on each side of the vertical fin of the aircraft, the lower cavity backed slot antenna in each pair being a VHF low band antenna tilted from the vertical axis of the aircraft by about 24°. The preferred embodiment of the present aircraft VHF television receiving antenna system includes a signal processing circuit incorporating solid state switching for selecting antenna coverage, high and low pass filter circuits, passive combining networks providing 180° phase shift necessary for omnidirectional azimuth coverage, low noise preamplifiers for each television band, and other features hereinafter described.

It is accordingly an object of this invention to provide an aircraft television antenna receiving system having selectable left, right, or omnidirectional azimuth response characteristics.

It is a further object of the present invention to provide an aircraft television antenna receiving system having VHF high band slots which are vertically disposed, and VHF low band slots which are tilted from the vertical axis of the aircraft for improved matching characteristics. It is yet another object of the present invention to provide a television antenna system for use in an aircraft having antenna elements which are tilted with respect to the vertical axis of the aircraft, thereby causing cross-polarization to increase at the sides of the aircraft for providing a response to vertical polarization to the left and right sides of the aircraft.

Figure 1:
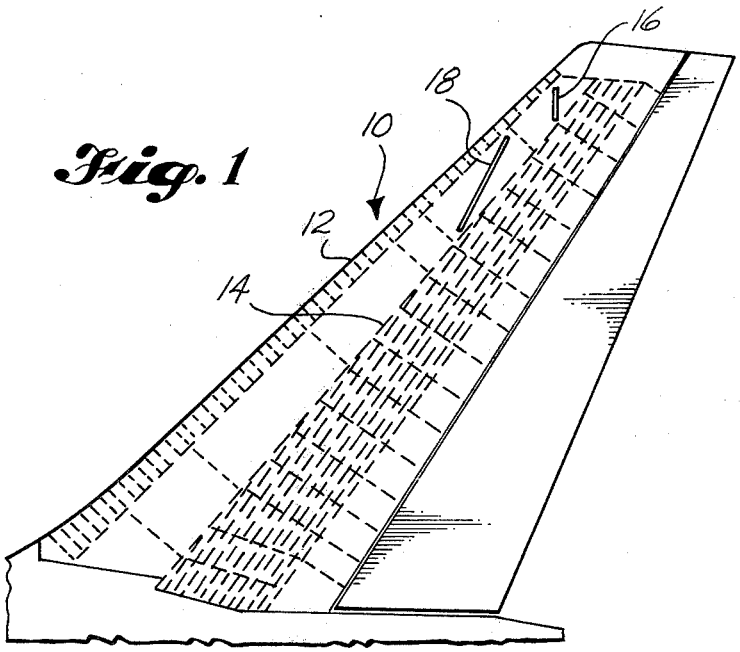
Figure 2:
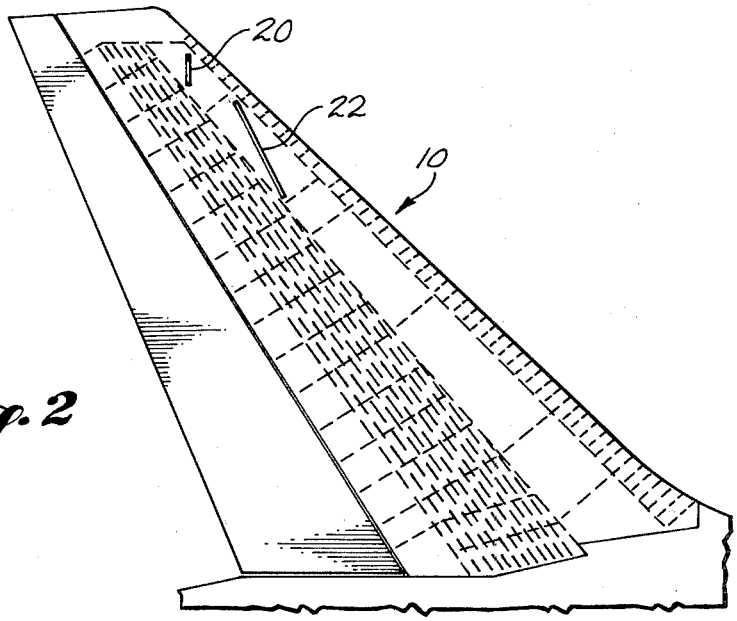
Figure 3:
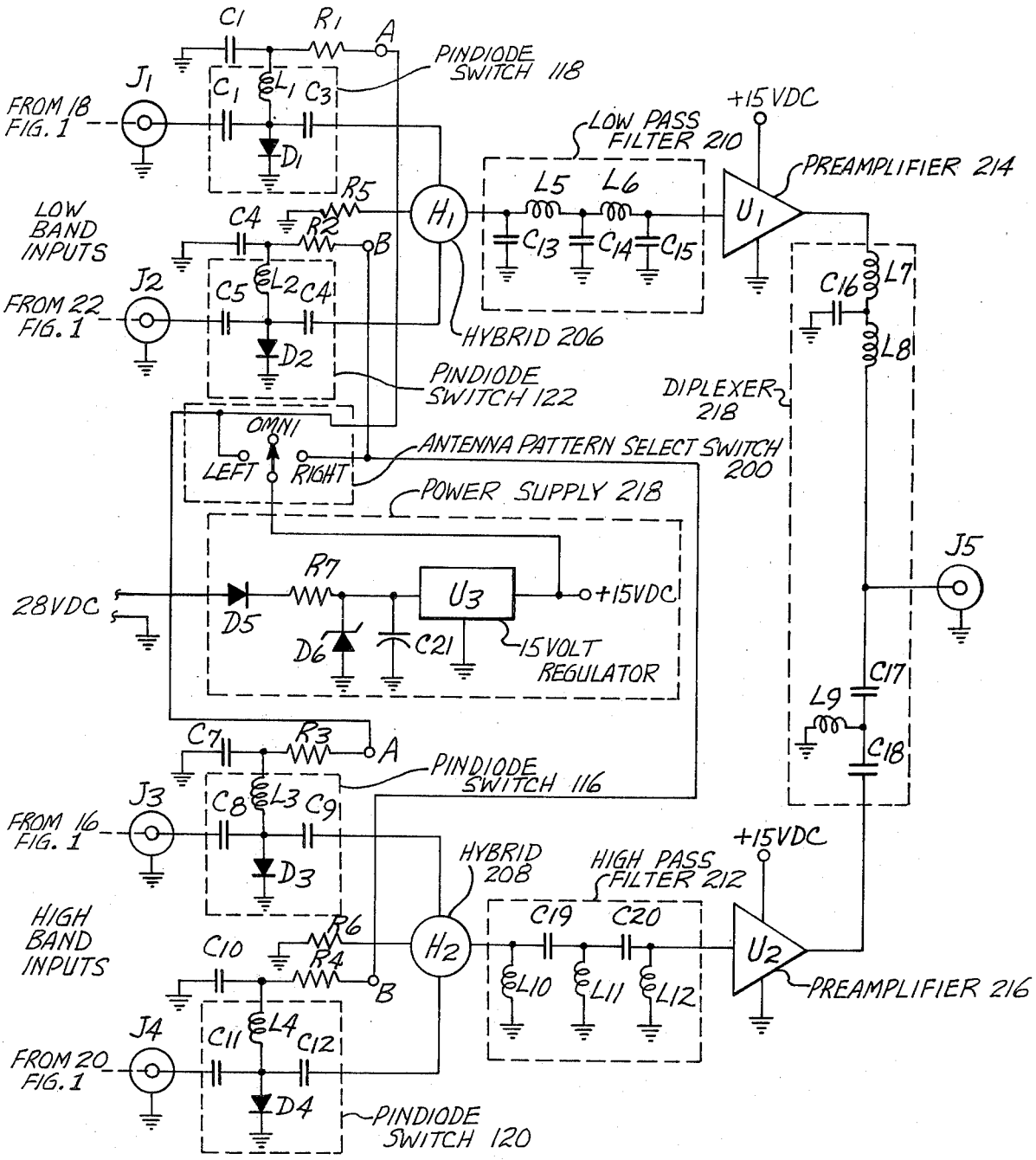

A full understanding of the invention, and of its further objects and advantages and the several unique aspects thereof, will be had from the following description when taken in conjunction with the accompanying drawings in which:

FIG. 1 is an elevation view partly in section of the present system slot antennas installed on the right side of the vertical fin in the cavity formed between the auxiliary and front spars of the vertical fin of a commercial transport aircraft;

FIG. 2 is an elevational view of the aircraft vertical tail fin of FIG. 1, however showing the opposite or left side thereof as viewed down the fuselage towards the tail of the aircraft—this view showing how the mirror image pair of cavity backed slot antennas are installed; and FIG. 3 is a complete schematic circuit diagram of the signal processing network of the present aircraft television receiving antenna system, which signal processing network is coupled from the pairs of slot antennas of FIGS. 1 and 2 to the output terminal of the present antenna system.

Turning now to FIG. 1, the antenna array portion of the present aircraft very high frequency television receiving antenna system is seen to include a pair of cavity backed slot antennas 16 and 18. Cavity backed slot antennas 16 and 18 on the right side of vertical fin 10 comprise one part of the antenna array, and turning to FIG. 2 which shows the left side of vertical fin 10 it can be seen that the other half of the antenna array comprises cavity backed slot antennas 20 and 22. Cavity backed slot antennas 16 and 20 are disposed parallel with the vertical axis passing through the vertical fin 10 of the aircraft. Antenna elements 16 and 20 are the very high frequency band high band slot antennas of the present aircraft television antenna receiving system, whereas antenna elements 18 and 22 comprise the low band television antenna system elements and are tilted at an angle of 24° from the vertical axis of the aircraft passing through the central plane of vertical fin 10. It should be noted from FIG. 1 that the cavity for slot antennas 16 and 18 are formed by auxiliary spar 12 and front spar 14. The cavity for slot antennas 20 and 22 on the left side of vertical fin 10 are also formed between the auxiliary spar and front spar as can be seen from FIG. 2.

The aforementioned tilting of low band slot antennas 18 and 22 from the vertical by approximately 24° improves the impedance match since a longer slot will have a larger radiation resistance. Low band television antenna slots 18 and 22 are about 73" long which represents 0.34 wave length at channel 2 and 0.52 wave length at channel 6. An observation of the pitch plane pattern indicated reflection from the fuselage forward characteristic of a horizontally polarized antenna one wave length above a ground plane. Tilting of the low band television antenna slots causes the maximum radiation to lift off the horizon forward and peak below the horizon aft. The slot radiates with a figure of eight pattern in the pitch plane excluding fuselage reflections. The tilt also causes the cross polarization to increase at the sides of the aircraft providing some response to vertical polarization to the left and right of the aircraft. This could provide somewhat limited television coverage in countries using a vertical polarization. However, the antenna is designed for horizontal polarization as its primary objective although there is some loss of gain estimated at less than 1 dB because of the tilt angle.

The principal plane patterns of high band television slot antennas 16 and 20 at channel 7 where the slots are $4\frac{1}{2}$ wave lengths above the fuselage result in the many lobes seen in the pitch plane pattern. High band slots 16 and 20 are about 24" long which is 0.36 wave lengths at channel 7. The roll plane pattern indicated some lobing caused by the presence of the low band slots being excited as parasitic radiators. As noted before, the high band slot 16 and low band slot 18 and also the high band slot 20 and low band slot 22 each comprise a pair of antennas sharing a common cavity. This is done to increase the cavity volume of the low band antenna to improve its impedance match. The 24" slots do not influence the 73" slots since the shorter slots are not efficient radiators at the VHF low band.

Turning now to FIG. 3 the schematic of the signal processing circuit portion of the present aircraft antenna television receiving antenna system is seen to include input jacks J1, J2, J3, and J4. These jacks are connected by equal lengths of coaxial transmission line to slot antennas 18, 22, 16, and 20. The output of the signal processing circuit portion of the system shown in FIG. 3 is provided at J5 which is the RF output terminal of the present system and is coupled downstream to the television tuner aboard the aircraft. Proceeding now with a brief general description of the schematic diagram of FIG. 3, it will be noted that a pair of PIN diode switching means 118 and 116 are coupled to jacks 1 and 3, respectively, which jacks are further coupled through coaxial transmission lines to VHF low band slot 18 and VHF high band slot 16. Further, it can be seen that a pair of PIN diode switching means 122 and 120 are coupled to jacks J2 and J4, which jacks are respectively coupled to low band antenna 22 and high band antenna 20. Antenna pattern select switching circuit 200 provides the logic to select the left or right side antennas and also provides an omnidirectional position when the switch is in the center position as shown in the schematic of FIG. 3. It can be seen that antenna pattern select switching means 200 provides the power to forward bias the appropriate PIN diode switching means as selected by the operator of the antenna pattern select switch 200. Selecting the appropriate antenna coverage omnidirectional in azimuth, or to either the left or right of the aircraft is done to minimize ghosts or co-channel interference. A 3 dB hybrid 206 is coupled between PIN diode switching means 118 and PIN diode switching means 122 with the output coupled downstream to low pass filter circuit 210. Also a 3 dB hybrid 208 is coupled between the outputs of PIN diode switching means 116 and PIN diode switching means 120 with the output connected downstream to high pass filter circuit means 212. The aforementioned 3 dB hybrids 206 and 208 provide 180° phase shift for the hereinbefore discussed antenna elements of the antenna array. Low pass filter circuit 210 is coupled downstream of hybrid 206 to preamplifier circuit 214, and hypass filter circuit 212 is coupled downstream of hybrid 208 to preamplifier 216. Low pass filter circuit 210 has a 90 MHz corner frequency, and hypass filter circuit 212 has a corner frequency of 170 MHz. Low pass filter circuit 210 and high pass filter circuit 212 minimize the amplitude of second order products in the television bands from the VHF FM broadcast band, VOR, and VHF AM communications. Low noise preamplifiers 214 and 216 have a nominal gain of 20 dB over the very high frequency high and low band. Power supply 218 is a regulated DC power supply which provides a constant voltage to the signal processing circuit of FIG. 3, including preamplifier circuits 214 and 216 thereby providing freedom of noise and voltage spikes which may occur on the normal 28 volt DC aircraft power sources aboard the aircraft. Diplexer circuit 218 is utilized for combining outputs from preamplifier circuits 214 and 216 with low insertion loss and high isolation with respect to out of band TV signals.

As noted herein before, a total of four PIN diode switching means are required to achieve the left/right coverage pattern. In the omnidirectional mode all PIN diodes are unbiased and drawing no current. This permits the antenna to function fail safe. The schematic diagram of the circuitry for the switch is shown for a type HP 3001 PIN diode manufactured by the Hewlett Packard Corporation.

Bias current as hereinbefore mentioned for PIN diode switching circuits 118, 122, 116, and 120 are taken from regulated 15 volt power supply means 218 with single pole three position (SP3T) antenna pattern selector switching means 200 which provides the switching logic. As seen in the schematic diagram of FIG. 3 the diode switching means was selected to function in parallel across the coaxial 50 ohm transmission lines coming into jacks 1, 2, 3 and 4. This parallel connection was incorporated in the signal processing circuit although lead inductance does begin to limit the isolation at the higher frequencies.

The selection of low pass filter 210 and high pass filter 212 characteristics hereinbefore given was influenced by a number of selection factors which included:

(1) Isolation between the VHF communications antenna on the top centerline of the aircraft fuselage and the TV antenna on the vertical fin;

(2) Strength of VHF FM broadcast systems;

(3) Strength of VOR stations in terminal areas;

(4) Strength of other television signals;

(5) Second order intercept of the preamplifier circuit.

Diplexer circuit 218 functions to combine the outputs of preamplifier circuits 214 and 216 with a minimum of degradation. Diplexer circuit 218 is formed from two 3 elements "T" configured Tchebycheff high and low pass filters connected back to back. In this manner amplified noise from the unused preamplifier is reduced to a value below the equivalent at the input of the preamplifier. Because of the limited attenuation of VHF FM signals in the low pass filer the diplexer also services to attenuate second order products created by the low band preamplifier which could degrade performance in the VHF TV high band. An alternative to the diplexer circuit 218 would be a hybrid similar to hybrids 206 and 208, however, the hybrid use would offer no attenuation to second order products created by the low band preamplifier and degrade the signal to noise ratio by 3 dB. The diplexer in addition provides some attenuation to VHF communications signals which have been amplified by the preamplifiers 214 and 216. Hybrids 206 and 208 may comprise Anzac Model HH-107 manufactured by Anzac Electronics, Division of Adams Russell Corporation of Waltham, Massachusetts. As hereinbefore mentioned, the hybrids combine the outputs from right and left vertical fin side slots with the required 180° phase shift to produce an omnidirectional azimuth response. As hereinbefore mentioned, equal length transmission lines are required from the feed points of the slots to the input ports, viz. jacks J1, J2, J3 and J4 of the present signal processing circuit. An additional benefit realized by the hybrids 206 and 208 is the preservation of lower VSWR as seen by high and low pass filters 210 and 212. This will maintain the corner frequencies of the filters in spite of potential higher VSWR values at the feed point of each of the slot antennas.

The signal processing circuit of FIG. 3 is configured so that even if the left or right azimuth coverage is desired, the hybrid remains in the circuit. The PIN diode switch produces a high reflection coefficient in the undesired antenna feed line and the desired signal is split in half. There is no loss of signal strength in the omnidirectional mode. The complexity of switching out the hybrid during left or right side coverage is not considered cost effective because the signal strength will usually be adequate in a multi-path (ghosting) situation.

Preamplifiers 214 and 216 may comprise a type WJ-A75-3 manufactured by the Watkins Johnson Corporation of Palo Alto, Calf. and have a nominal gain of 20 dB over a frequency range of 10 to 500 MHz. Preamplifier circuits 214 and 216 terminate respectively low pass filter circuit 210 and high pass circuit 212 with a typical VSWR of less than 1.5:1. Therefore, there should be minimal change in the corner frequencies due to preamplifier input impedance. Fifteen volt regulated power supply 218 may include 15 volt regulator U3, a National Semiconductor Corporation of Santa Clara, Calif. type LM 140-15. Maximum estimated current drawn from power supply 218 is 84 mA with 2 PIN diodes in the forward bias condition. With the antenna pattern selector switch 200 in the omni mode, the nominal current is estimated at 34 ma.

We claim:

1. In an aircraft vertical fin structure, a television receiving antenna array comprising:

a first pair of cavity backed slot antennas disposed in a first major side surface of said vertical fin structure;

a second pair of cavity backed slot antennas disposed in a second major side surface of said vertical fin structure; and, wherein said first pair of cavity backed slot antennas is disposed in said first major side surface of said vertical fin structure intermediate the auxiliary spar and front spar of said vertical fin structure, and said second pair of cavity backed slot antennas is disposed in said second major side surface of said vertical fin structure intermediate the auxiliary spar and front spar of said vertical fin structure.

2. An aircraft television receiving antenna system comprising:

a first pair of cavity backed slot antennas;

a second pair of cavity backed slot antennas;

said first pair of cavity backed slot antennas including a VHF high band cavity backed slot antenna and a VHF low band cavity backed slot antenna;

said second pair of cavity backed slot antennas including a VHF high band cavity backed slot antenna and a VHF low band cavity backed antenna;

switching means for selecting the output of at least one of said VHF high band cavity backed slot antennas and the output of at least one of said VHF low band cavity backed slot antennas for coupling to the input terminal of a television receiver tuner.

3. An aircraft television receiving antenna system comprising:

first and second slot antennas tuned to a first predetermined frequency;

third and fourth slot antennas tuned to a second predetermined frequency higher than said first predetermined frequency;

first and second switching means coupled to said first and second slot antennas;

second and third switching means coupled to said third and fourth slot antennas;

a low pass filter circuit coupled to a first preamplifier circuit;

a high pass filter circuit coupled to a second preamplifier circuit;

a first hybrid connected to the outputs of said first and second switching means and having an output terminal;

a second hybrid connected to the outputs of said second and third switching means;

said low pass filter circuit responsive to the output of said first hybrid;

said high pass filter circuit responsive to the output of said second hybrid;

an antenna pattern select switching circuit coupled to said first and second switching means for controlling the selection of slot antennas by said first and second switching means; and, a diplexer circuit responsive to the outputs of said first and second preamplifier circuits for providing a radio frequency output signal for utilization by a television tuner.

4. The invention according to claim 3 wherein said low pass filter circuit has a corner frequency of about 90 MHz, and said high pass filter has a corner frequency of about 170 MHz.

5. In an aircraft vertical fin structure, a television receiving antenna array comprising:

a first pair of cavity backed slot antennas disposed in a first major side surface of said vertical fin structure;

a second pair of cavity backed slot antennas disposed in a second major side surface of said vertical fin structure; and wherein a first of said first pair of cavity backed slot antennas is disposed parallel to the vertical axis of said vertical fin structure, a second of said first pair of cavity backed slot antennas is disposed with about a 24° tilt with respect to the vertical axis of said vertical fin structure, a first of said second pair of cavity backed slot antennas is disposed parallel to the vertical axis of said vertical fin structure, and, a second of said second pair of cavity backed slot antennas is disposed with about a 24° tilt with respect to the vertical axis of said vertical fin structure.

* * * * *